United States Patent [19]

Leonard

[11] 4,456,663

[45] Jun. 26, 1984

[54] HOT-DIP ALUMINUM-ZINC COATING METHOD AND PRODUCT

[75] Inventor: Ralph W. Leonard, Pittsburgh, Pa.

[73] Assignee: United States Steel Corporation, Pittsburgh, Pa.

[21] Appl. No.: 439,157

[22] Filed: Nov. 4, 1982

Related U.S. Application Data

[63] Continuation-in-part of Ser. No. 326,732, Dec. 2, 1981, abandoned.

[51] Int. Cl.[3] ..... B32B 15/10; C23C 1/08

[52] U.S. Cl. ..... 428/653; 427/399; 427/406; 427/433; 427/436; 428/654; 428/926; 428/939

[58] Field of Search ..... 427/329, 374.4, 328, 427/376.5, 399, 376.8, 405, 406, 433, 436, 431; 148/6.27; 428/653, 659, 939, 654, 926; 75/146, 178 A

[56] References Cited

U.S. PATENT DOCUMENTS

| | | | |
|---|---|---|---|
| 2,986,808 | 6/1961 | Schnedler | 427/436 |
| 3,058,206 | 10/1962 | Mets | 427/436 |
| 3,343,930 | 9/1967 | Borillo et al. | 428/653 |
| 3,393,089 | 7/1968 | Borzillo et al. | 428/653 |
| 3,782,909 | 1/1974 | Cleary et al. | 427/433 |
| 3,860,438 | 1/1975 | Shoemaker | 427/433 |
| 3,952,120 | 4/1976 | Horton et al. | 427/433 |
| 4,171,392 | 10/1979 | Sievert et al. | 427/433 |

FOREIGN PATENT DOCUMENTS

| | | | |
|---|---|---|---|
| 627433 | 3/1936 | Fed. Rep. of Germany | 427/436 |
| 634135 | 10/1936 | Fed. Rep. of Germany | 427/436 |

OTHER PUBLICATIONS

Zoccola et al., ASTM STP 646, S. K. Coburn Ed. American Society for Testing & Materials, 1978, pp. 165–184.

Gittings et al., Trans. ASM, 1951, vol. 4, pp. 587–610.

*Primary Examiner*—Sadie L. Childs

*Attorney, Agent, or Firm*—Arthur J. Greif

[57] ABSTRACT

Hot-dip coated steel articles having a coating containing about 55% aluminum, 43% zinc, 2% silicon, are known to exhibit an optimum combination of general corrosion resistance, more durable than zinc coatings; while providing more galvanic protection to cut edges and areas of mechanical damage than hot-dip aluminum coatings. It has now been found that coatings containing 12 to 24% zinc, up to 4% silicon, balance aluminum, provide galvanic protection equal to or superior to such known coatings, while providing enhanced general corrosion resistance, approaching that of aluminum coatings.

16 Claims, 5 Drawing Figures

HOT-DIP ALUMINUM-ZINC COATING METHOD AND PRODUCT

Figure 1A:
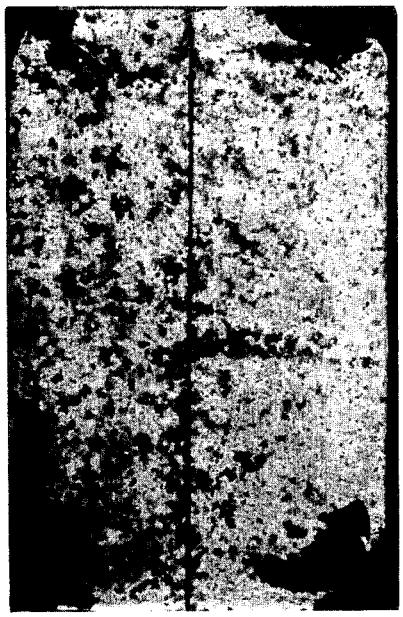
Figure 1B:
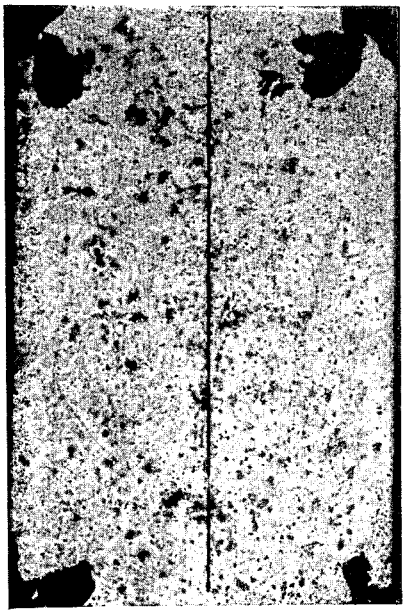
Figure 1C:
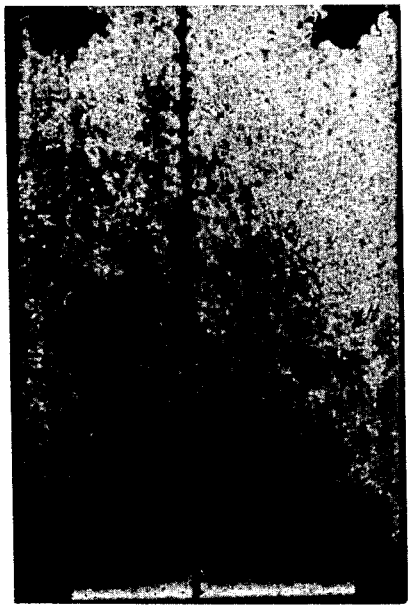
Figure 1D:
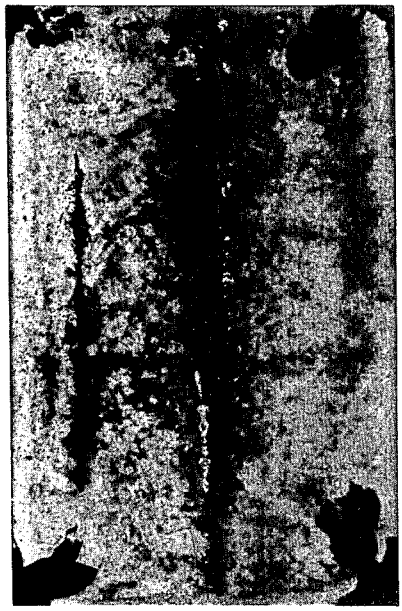

This application is a continuation-in-part of application Ser. No. 326,732, filed Dec. 2, 1981 and now abandoned.

A widely employed practice for coating ferrous metal surfaces is the hot-dip method in which the surface to be coated is immersed in a molten bath of the coating metal. For coatings which are employed primarily to provide corrosion protection of the underlying ferrous base, e.g. steel sheet and strip, baths containing aluminum or baths containing zinc are most generally employed. In virtually all corrosive environments, zinc is anodic to steel and therefore offers sacrificial, galvanic protection to the steel; even if the zinc barrier itself should be damaged or cut, exposing the underlying steel surface. Aluminum, on the other hand, is cathodic to steel in many corrosive environments. Thus, while aluminum will generally exhibit substantially lower, overall dissolution rates (as compared with zinc), it is not capable of providing galvanic protection to the underlying ferrous surface, if the coating should for some reason be damaged. This lack of galvanic protection results in a tendency of commercial aluminum-coated products, i.e., those using pure aluminum or aluminum-silicon (5 to 11% silicon) coatings, to develop objectionable rust stain discoloration in a short time at sheared edges or other discontinuities in the coating. Furthermore, such lack of sacrificial protection can also lead to relatively rapid corrosion of the underlying ferrous surface, under conditions of continual condensation or where water accumulates in ponds.

U.S. Pat. No. 3,343,930 describes a hot-dip coated article containing a combination of zinc and aluminum which, (i) as a result of its zinc content, overcomes the problem of premature discoloration caused by rust-stain bleeding and (ii) as a result of its aluminum content, exhibits an overall ("general") corrosion rate significantly less than that of zinc coatings. While this patent discloses a coating bath containing from 28 to 75% zinc, balance aluminum and silicon, further studies (Zoccola et al., "Atmospheric Corrosion Behavior of Al-Zn Alloy Coated Steel", ASTM STP 646, 1978, pp. 165–184) have shown that optimum results are achieved with a bath containing about 43% zinc, 55% aluminum and 2% silicon. This optimum product is sold commercially under the trade name Galvalume. Due to such optimization, however, in most environments the overall or "general" corrosion rate of Galvalume is far greater than that of commercial aluminum-coated products.

It has now been found that hot-dip coated products can be produced which exhibit resistance to rust staining about equal to that of Galvalume, while concomitantly providing a "general" corrosion resistance far superior to that of Galvalume—approaching that of aluminum-coated steels. Such an improved combination of corrosion resistance is achieved by utilizing a hot-dip bath consisting essentially of 12 to 24% zinc, less than 4% silicon, 0.3 to 3.5% iron (which is an incidental impurity normally encountered in commercial hot-dip plating baths) and balance aluminum. In addition to the superior combination of corrosion resistance, the coatings of this invention are more ductile in that they exhibit lower tendencies towards crazing during forming operations.

It has further been found that the use of silicon, which is a necessary constituent in Galvalume-type baths, has a detrimental effect on the rust stain resistance of the resulting coating; whereas baths containing less than about 18% zinc can produce effective, adherent coatings with materially reduced amounts of silicon or essentially no silicon.

Other advantages of the instant invention will become more apparent from a reading of the following description when taken in conjunction with the appended claims and the following drawings in which:

FIG. 1; (A), (B), (C) and (D) exhibit the rust staining of Aluminum and Aluminum-Zinc coatings after about 15 months exposure at an industrial site, and FIG. 2; (*a*), (*b*), (*c*), (*d*), (*e*), (*f*) and (*g*) show the rust staining on sheared edges of Al and Al-Zn coated samples after one year of exposure (7X).

Various coating bath compositions falling within the scope of this invention were evaluated. For purposes of comparison, two control baths were included in this investigation; one simulated a commercial aluminum coating composition (with 6 to 7% silicon) and the other simulated the commercial Galvalume composition. All the baths were prepared from commercially pure aluminum (99.9% minimum purity), special high-grade zinc (99.99% minimum purity) and aluminum-silicon (11.7% silicon) master alloy materials. In a manner similar to that encountered in commercial hot-dip baths, iron, which dissolved both from the steel strip and from the submerged steel rigging components was also present as a significant constituent. The baths were contained in an alumina-lined stainless steel pot. A graphite coating was applied both to the alumina lining and to the rigging components, to minimize molten metal attack on those components. The steel base employed was representative of a commercial quality low carbon rimmed steel.

Hot-dip coating was accomplished by a procedure analogous to that shown in U.S. Pat. No. 3,393,089 and the above-noted Zoccola article, the disclosures of which are incorporated herein by reference. Thus, the steel sheet was cleaned in an aqueous-silicate solution, annealed in-line under reducing conditions and cooled to a temperature slightly above bath temperature prior to entry into the bath. Coating baths were maintained at a temperature of from 75° to 100° F. (40° to 55° C.) above the liquidus temperature for each bath concentration. No changes in bath temperature were made to account for the relatively small effect of the silicon additions on the liquidus temperature. To achieve good wetting between the steel and the bath metal, the annealing temperatures employed were higher than those shown in the above-noted references; that is, the annealing cycle included heating to a temperature of 1450° F. (790° C.). The reducing furnace atmosphere was maintained by introducing a hydrogen-nitrogen mixture into the snout just above the bath surface. A baffle was located inside the snout to prevent the incoming cold gases from impinging directly onto the strip. Air-knives were used to control the thickness of the coating on the strip. No special measures were employed to provide enhanced cooling rates to cool the strip (as in U.S. Pat. No. 3,782,909) after it exited from the coating bath. However, because of the low line speeds of the coating line employed in this investigation, the air knives, themselves, caused a considerable degree of cooling. Thus, the cooling rate caused by the air knives averaged about 30° F. (17° C.) per second within the first 8 inches (20 cm) after the strip emerged from the bath. Subsequently, cooling resulting from normal, ambient air cooling, provided a cooling rate within the range of 8° to 10° F. (4° to 5° C.) per second, while the strip was at a temperature greater than 700° F. (370° C.). All the baths exhibited good fluidity characteristics, in that smooth, uniformly thick coatings of about 1 mil thick (0.025 millimeters) were readily attained.

Forming-test results—Coating adherence was evaluated in bead-forming tests, 100-inch-pound impact tests and ASTM-A525 coating bend tests. No flaking was observed in the latter two tests, but a considerable amount was observed on some samples in the bead-forming tests. It is generally accepted that for a given hot-dip coated product, coating adherence is primarily a function of the alloy-layer thickness—the thicker the alloy layer, the poorer the adherence. However, this expected behavior was not encountered with respect to the inventive coatings—coatings from baths with lower zinc contents generally exhibited better adherence, even when the alloy-layer was significantly thicker. Apparently, the ductility of the outer coating metal layer has an influence on the overall tendency to exhibit flaking. Thus, with respect to the inventive coatings, overall flaking tendency appears to be a complex function both of the alloy-layer thickness and the outer coating metal ductility.

Crazing tendency was observed on the impact test samples and the 3T-bends for ASTM A525 bend-test samples. These tests showed that crazing was generally a function of the ductility of the outer coating metal layer—the tendency to crazing increasing both as the zinc content and silicon content of the outer coating increased. Thus, the Galvalume-type coating and the coatings of this invention containing in excess of about 1.5 percent silicon exhibited "Moderate" crazing in such tests; whereas those containing less than 1% silicon, as well as the commercial aluminum coating exhibited "Light" crazing.

Corrosion Behavior

Sacrificial Corrosion Characteriscs—The sacrificial properties of the coating, i.e. the ability to resist rust stain discoloration, were evaluated in two different atmospheric tests. FIG. 1 shows the rust staining encountered after about fifteen months exposure at a test sight in Monroeville, Pennsylvania, comparing two coatings produced in accord with the instant invention: (A) 18% zinc and (B) 24% zinc, with that of (C) the Galvalume-type coating and (D) the commercial aluminum coating containing 7% silicon. As expected, the rust staining in the area adjacent to the grooves for the aluminum coating (D) was significantly greater than that of the Galvalume sample (C). It may be seen, however, that the discoloration exhibited by the inventive samples is essentially the same as that of the Galvalume sample.

Figure 2:
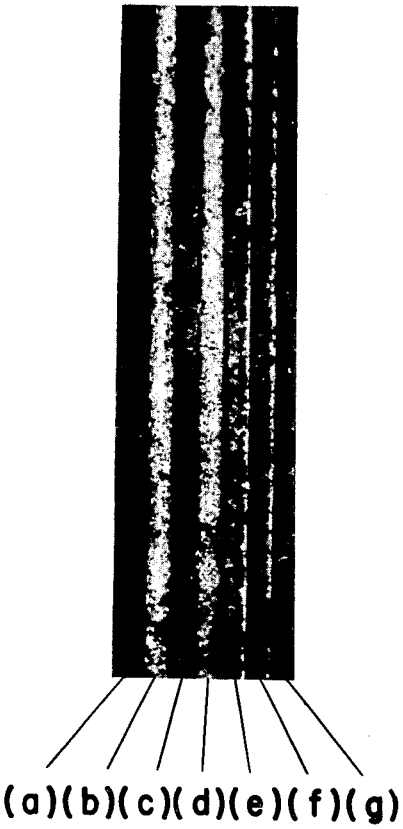

When little or no silicon is used (desirably less than 0.3 and preferably less than 0.1% silicon), the ability of the instant coatings to inhibit red rust formation is further enhanced. This enhancement is shown in FIG. 2, which compares the red rust formation on sheared edges of sheet samples after one year exposure at the same Monroeville, Pennsylvania test-site. The superiority of the 12.4% zinc and 17.8% zinc samples is clearly evident. The seven samples depicted are: (a) aluminum—7% silicon, (b) 12.4% zinc—no silicon, (c) 15% zinc—8% silicon, (d) 17.8% zinc—no silicon, (e) 43% zinc—2% silicon (Galvalume-Type), (f) 2% zinc—6% silicon and (g) 33% zinc—2% silicon (another Galvalume-type). The detrimental effect of silicon even for a zinc content within the scope of this invention, i.e. sample (c) containing 15% zinc, but containing 8% silicon, is clearly evident.

These results dramatically emphasize the further benefit of employing coatings containing from 12 to 18% zinc. As shown in U.S. Pat. No. 3,393,089, in the production of hot-dip aluminum-zinc coatings containing from 28 to 75% zinc; silicon is a necessity—to retard the growth of the interfacial alloy-layer and produce coatings with acceptable adhesion. By contrast, for those coatings within the instant invention, but containing less than 18% zinc, preferably less than 16% zinc, acceptable adhesion (for many commercial applications such as roofing and siding) can be produced in silicon-free baths, without resort to special coating techniques. Although the bath reactivity of essentially silicon-free baths is greater than if silicon (within the range of the U.S. Pat. No. 3,393,089) had been employed, such bath reactivity as measured by the parabolic rate constant "a" for the silicon-free baths, varied from about 0.05 to 0.07 $mil^2$ per second (depending on the amount of zinc employed) and none of the silicon-free baths exhibited a reactivity greater than that of a pure-aluminum, type-2 coating bath.

"General" Corrosion Characteristics—The general corrosion resistance provided by coatings of the instant invention was evaluated by the Kesternich method-DIN 50018. This test is a well accepted, rapid corrosion test for comparison of the resistance of similar-type protective coatings to industrial atmospheres, particularly those rich in sulphur dioxide. The weight loss of four different zinc concentrations within the scope of this invention was compared with that of three different Galvalume-type zinc concentrations, after 20 cycles of exposure. The results thereof are shown in the Table below. It is seen that the Galvalume-type samples exhibit general corrosion rates about 2 to 3 times greater than those of the instant invention.

TABLE

| Coating Weight Loss After 20 Cycles Exposure in Kesternich Test | | |
|---|---|---|
| Coating Bath Composition | Weight Loss* mg/sq in. | Reduction in Coating Thickness, mils |
| 11.9% Zn, 0.69% Si | 14.3 | 0.31 |
| 12.7% Zn, 0.83% Si | 15.8 | 0.34 |
| 18.3% Zn, 0.87% Si | 15.8 | 0.32 |
| 24.4% Zn, 0.67% Si | 16.8 | 0.33 |
| 28.6% Zn, 1.6% Si | 28.3 | 0.50 |
| 34.2% Zn, 1.6% Si | 39.4 | 0.69 |
| 43.0% Zn, 1.7% Si | 49.0 | 0.79 |

*Average of either 2 or 3 specimens. Weight loss in mg/sq inch of total surface area.

While the examples above were directed to the production of a specific overall coating thickness of about 1 mil, it should be understood, with respect to sheet product, that such overall coating thicknesses will generally range from 0.2 to 2 mils and most often from 0.5 to 1 mils. To achieve such coating thicknesses, immersion times of the order 0.5 to 10 seconds will generally be employed, preferably 1 to 5 seconds, so as to achieve an interfacial alloy layer having a thickness of 0.01 to 0.2 mils. However, for superior deformation properties, it is preferable that the thickness of the interfacial layer be less than 0.1 mil. By contrast, when coating massive structures such as castings, forgings, plates, bars, and preformed pipes, overall coating thicknesses of up to 30 mils are often desired, therefore requiring significantly extended immersion times. With respect to the latter structures, interfacial alloy layers of the order of 0.25 to 1 mils, or even greater, may result. However, whatever the product, the thickness of the interfacial layer will generally be significantly thinner (preferably $<10\%$) of the overall coating thickness.

I claim:

1. In the method for producing corrosion-resistant coatings, metallurgically bonded to ferrous-base articles, which comprises dipping a clean surface of said article into a molten bath containing aluminum and zinc for a period at least sufficient to form an aluminum-zinc coating thereon with an interfacial alloy layer having a thickness greater than about 0.01 mils, said layer resulting from the reaction of the ferrous surface with the bath, removing the coated surface from said bath and cooling the molten layer adhering thereto, the improvement for producing a coating which provides a superior combination of general and sacrificial corrosion resistance, which comprises using a bath consisting essentially of 12 to 24% zinc, 0.3 to 4% silicon, 0.3 to 3.5% iron and the balance aluminum.

2. The method of claim 1 wherein said ferrous-base article is steel sheet and said sheet is dipped into the bath for a period to form an alloy layer having a thickness less than 0.2 mils.

3. The method of claim 2, wherein said bath contains less than 1% silicon and less than 2.5% iron.

4. The coated product produced by the method of claim 1.

5. The coated product produced by the method of claim 3.

6. In the method for producing corrosion-resistant coatings, metallurgically bonded to steel sheet, which comprises dipping a clean surface of said sheet into a molten bath containing aluminum and zinc for a period of 0.5 to 10 seconds and sufficient to form an aluminum-zinc coating thereon with an interfacial alloy layer having a thickness of 0.01 to 0.2 mils, said layer resulting from the reaction of the ferrous surface with the bath, removing the coated surface from said bath and cooling the molten layer adhering thereto, the improvement for producing a coating which provides a superior combination of general and sacrificial corrosion resistance, which comprises using a bath consisting essentially of 12 to 24% zinc, 0.3 to 4% silicon, 0.3 to 3.5% iron and the balance aluminum.

7. The method of claim 5 wherein said sheet is dipped into the bath for a period to form coating having an overall thickness of 0.2 to 2 mils.

8. The method of claim 7, wherein said bath contains less than 1% silicon and less than 2.5% iron.

9. The method of claim 7, wherein said coating is applied to the entire surface of said sheet in a continuous hot-dipping line.

10. The coated sheet produced by the method of claim 9.

11. In the method for producing corrosion-resistant coatings metallurgically bonded to ferrous-base articles, which comprises dipping a clean surface of said article into a molten bath containing aluminum and zinc for a period at least sufficient to form an interfacial layer having a thickness greater than about 0.01 mils, said layer resulting from the reaction of the ferrous surface with the bath, removing the coated surface from said bath and cooling the molten layer adhering thereto, the improvement for producing a coating which provides a superior combination of sacrificial and general corrosion resistance, which comprises using a bath consisting essentially of 12 to 18% zinc, less than 0.3% silicon, 0.3 to 3.5% iron, balance aluminum.

12. The method of claim 11, wherein the ferrous-base article is steel sheet and said sheet is dipped into the bath for a period of 0.5 to 10 seconds.

13. The method of claim 11, wherein the steel sheet is dipped into the bath for a period to form an alloy layer having a thickness less than 0.2 mils.

14. The method of claim 13, wherein said bath contains less than 0.1% silicon.

15. The method of claim 14, wherein said bath contains 12 to 16% zinc.

16. The coated sheet produced by the method of claim 12.

* * * * *